US010438597B2

(12) United States Patent
Biswas

(10) Patent No.: US 10,438,597 B2
(45) Date of Patent: Oct. 8, 2019

(54) DECODER-PROVIDED TIME DOMAIN ALIASING CANCELLATION DURING LOSSY/LOSSLESS TRANSITIONS

(71) Applicant: Dolby International AB, Amsterdam Zuidoost (NL)

(72) Inventor: Arijit Biswas, Nuremberg (DE)

(73) Assignee: Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 16/115,795

(22) Filed: Aug. 29, 2018

(65) Prior Publication Data

US 2019/0066702 A1 Feb. 28, 2019

Related U.S. Application Data

(60) Provisional application No. 62/553,042, filed on Aug. 31, 2017.

(51) Int. Cl.

| | |
|---|---|
| ***G10L 19/00*** | (2013.01) |
| ***G10L 19/02*** | (2013.01) |
| ***G10L 19/18*** | (2013.01) |

(52) U.S. Cl.

CPC ..... *G10L 19/0017* (2013.01); *G10L 19/02* (2013.01); *G10L 19/18* (2013.01); *G10L 19/0212* (2013.01)

(58) Field of Classification Search

CPC ..... G10L 19/0017; G10L 19/02; G10L 19/18; G10L 19/0212

(Continued)

(56) References Cited

U.S. PATENT DOCUMENTS 7,424,434 B2 * 9/2008 Chen ..... G10L 19/0017 370/465
7,617,097 B2 * 11/2009 Kim ..... G10L 19/0017 704/219

(Continued)

FOREIGN PATENT DOCUMENTS

| | | |
|---|---|---|
| WO | 1990/009022 | 8/1990 |
| WO | 2000/051108 | 8/2000 |

(Continued)

OTHER PUBLICATIONS

Riedmiller et al "Delivering Scalable Audio Experiences using AC-4" IEEE Transactions on Broadcasting, vol. 63, No. 1, Mar. 2017, pp. 179-198.

(Continued)

*Primary Examiner* — Edwin S Leland, III

(57) ABSTRACT

Systems and methods are described for switching between lossy coded time segments and a lossless stream of the same source audio. A decoder may receive lossy coded time segments that include audio encoded using frequency-domain lossy coding. The decoder may also receive a lossless stream, which the decoder plays back, that includes audio from the same source encoded using lossless coding. In response to receiving a determination that network bandwidth is constrained, the decoder may generate an aliasing cancellation component based on a previously-decoded frame of the lossless stream, which may be added to a lossy time segment at a transition frame. The sum of the aliasing cancellation component and the lossy time segment may be normalized using a weight caused by an encoding window. Audio playback of the lossy coded time segments may then be provided, beginning with the aliasing-canceled transition frame.

20 Claims, 6 Drawing Sheets

(58) Field of Classification Search
USPC ..... 704/500
See application file for complete search history.

(56) References Cited

U.S. PATENT DOCUMENTS 9,247,260 B1* 1/2016 Swenson ..... H04N 19/423
9,257,130 B2* 2/2016 Lecomte ..... G10L 19/005
9,866,673 B2* 1/2018 Gabel ..... H04W 4/90
2006/0247928 A1* 11/2006 Cowdery ..... G10L 19/022 704/229
2008/0253583 A1* 10/2008 Goldstein ..... H04R 1/1091 381/92
2009/0003714 A1* 1/2009 Subramaniam ..... H04N 19/176 382/232
2012/0022880 A1* 1/2012 Bessette ..... G10L 19/0212 704/503
2012/0128162 A1* 5/2012 Chen ..... G10L 19/0017 381/22
2013/0077696 A1* 3/2013 Zhou ..... H04N 19/176 375/240.24
2014/0016698 A1* 1/2014 Joshi ..... H04N 19/88 375/240.12
2014/0226721 A1* 8/2014 Joshi ..... H04N 19/159 375/240.13
2016/0198154 A1* 7/2016 Hsiang ..... H04N 19/70 375/240.03
2016/0301723 A1* 10/2016 Sinclair ..... H04L 65/4007
2017/0251214 A1* 8/2017 Chan ..... H04N 19/13
2018/0109807 A1* 4/2018 Sharman ..... H04N 19/463
2019/0066702 A1* 2/2019 Biswas ..... G10L 19/02

FOREIGN PATENT DOCUMENTS

WO 2008/009564 1/2008
WO 2008/012211 1/2008

OTHER PUBLICATIONS

Britanak, V. et al "Fast Computational Structures for an Efficient Implementation of the Complete TDAC Analysis/Synthesis MDCT/MDST Filter Banks" Signal Processing 89(7)pp. 1379-1394, Jul. 2009.

* cited by examiner

DECODER-PROVIDED TIME DOMAIN ALIASING CANCELLATION DURING LOSSY/LOSSLESS TRANSITIONS

CROSS-REFERENCE TO RELATED APPLICATION TECHNICAL FIELD

This application claims the benefit of priority from U.S. Patent Application No. 62/553,042 filed Aug. 31, 2017, which is hereby incorporated by reference in its entirety.

TECHNICAL FIELD

Embodiments herein relate generally to audio signal processing, and more specifically to switching between lossy coded time segments and a lossless stream of the same source audio.

SUMMARY OF THE INVENTION

Systems and methods are described for switching between lossy coded time segments and a lossless stream of the same source audio. A decoder may receive a stream of lossy coded time segments that includes audio encoded using a frequency-domain lossy coding method over a network. The decoder may also receive, over the network, a lossless stream that includes the audio encoded using a lossless coding method. The decoder may provide audio playback of the lossless stream. The lossy coded time segments and the lossless stream may be encoded from the same source audio, may also be time-aligned, and may have a same sampling rate.

In response to receiving a determination that network bandwidth is constrained, the decoder may generate an aliasing cancellation component based on a previously-decoded frame of the lossless stream. The generated aliasing cancellation component may be added to a lossy time segment at a transition frame. The sum of the aliasing cancellation component and the lossy time segment may be normalized using a weight caused by an encoding window applied to the transition frame, thereby providing aliasing cancellation on the transition frame. Audio playback of the lossy time segment may then be provided by the decoder, beginning with the aliasing-canceled transition frame.

In an embodiment, the aliasing cancellation component may be generated based on reconstructing an adjacent frame of the previously-decoded frames of the lossless stream as a sum of a lossy component and an aliasing cancellation component for the adjacent frame. The aliasing cancellation component for the adjacent frame may then be extrapolated to generate the aliasing cancellation component for the transition frame.

BRIEF DESCRIPTION OF THE FIGURES

This disclosure is illustrated by way of example and not limitation in the figures of the accompanying drawings, in which like references indicate similar elements, and in which.

DETAILED DESCRIPTION

Systems and methods are described for switching between lossy coded time segments (such as those encoded by the perceptually lossy AC-4 codec, developed by Dolby Laboratories, Inc., of San Francisco, Calif., and time segments of a lossless sub-streams (such as the lossless AC-4 codec) originating from the same source audio. A Time Domain Aliasing Cancelation (TDAC) process may be applied during the transition between non-aliased lossless coding (again, e.g., AC-4 lossless coding) and MDCT transform-based lossy coding (such as the coding used in the Audio Spectral Frontend, hereinafter referred to as ASF, in AC-4). The proposed solution does not require additional bits to be sent from the encoder side (as metadata) because adjacent decoded lossless samples (past frames, in the case of lossless to lossy switching, and future frames, in the case of lossy to lossless switching) are utilized to generate aliasing cancelation terms by the decoder.

If AC-4 lossless mode is used for music delivery over a network protocol, such as an Internet protocol, acute network bandwidth constraints may require transition to and from a fallback lossy AC-4 sub-stream. In many cases, fallback to ASF mode can be sufficient to preserve high-quality playback. Therefore, transitions to and from a frequency-domain lossy modified discrete cosine transform ("MDCT")-coded time segment, which may use overlapping windows, and a time segment coded by the lossless coder, which may use rectangular non-overlapping windows, should be handled efficiently.

Transitioning to and from lossy coding from lossless coding may present several challenges. To compute the decoded signal, a lossy MDCT frame relies on TDAC of adjacent windows (which is why overlapping windows are commonly used). The MDCT removes the aliasing part of the current frame by combining with the signal decoded in the following frame. Therefore, if the encoding mode of the next frame is lossless coding, the aliasing term of the frame coded with lossy coding is not canceled, since the frame coded with the lossless codec does not have the corresponding time domain alias cancelation components to cancel out the time domain aliasing of the previous lossy frame.

To handle the transitions seamlessly between the two modes using conventional techniques, the aliasing cancellation components for the lossy MDCT encoding are generally forwarded to the decoder by the encoder. This side information will not be available, if it is not sent by the encoder in advance. Furthermore, forwarding aliasing cancellation components is not an option for responding to bandwidth constraints, because the decoder performing the switching does not know a priori the transition points between encoding methods.

Figure 1B:
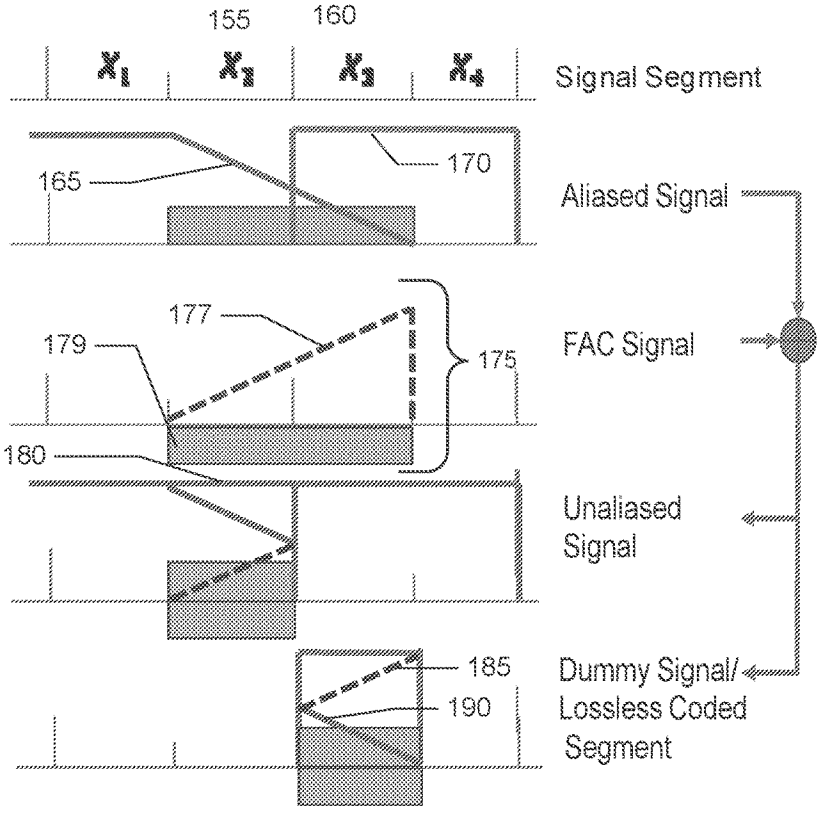
FIG. 1B (prior art)
FIGS. 1A-B show exemplary signal segments where forwarding aliasing cancelation is used to switch between a lossless stream and a lossy coded time segment, according to an embodiment.
Figure 1A:
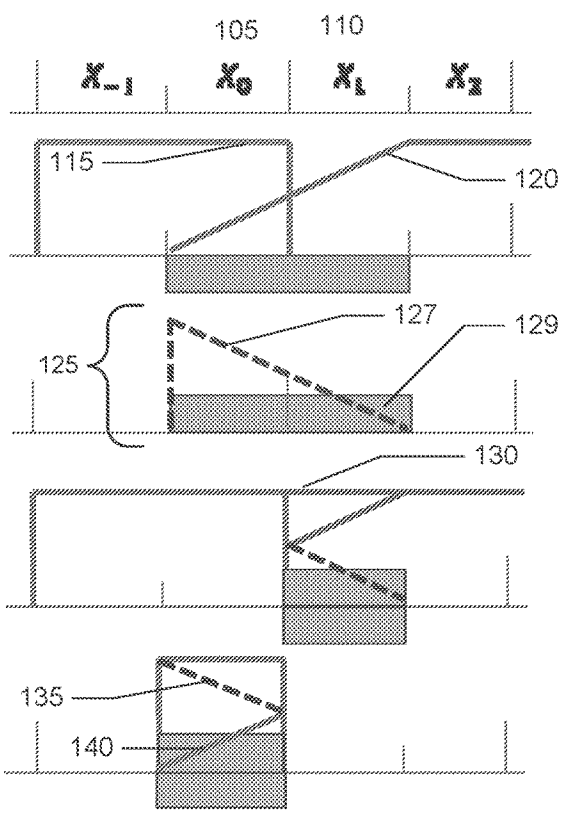
FIG. 1A (prior art)

FIGS. 1A-B show exemplary signal segments where forwarding aliasing cancelation is used to switch between a lossless stream and lossy coded time segments by an encoder, according to conventional forward aliasing cancelation. For designing seamless switching in the decoder, it is assumed that the transition is made from lossless coded stream 115 to the lossy coded time segment 120 (in diagram 100), and vice-versa (in diagram 150) by the encoder, and necessary steps required to do the seamless switching for the overall encoder-decoder system are managed on the encoder side, prior to transmitting the streams to the decoder. As seen in diagrams 100 and 150, lossless-coded time segments 115 and 170 are rectangular-windowed segments. Likewise, the MDCT windowed lossy-coded time segments 120 and 165 are also shown.

To compensate for the aliasing caused by switching between streams (handled at transition time segments $X_1$ 110 in diagram 100 and $X_2$ 155 in diagram 150), the encoder determines and transmits a forwarding aliasing cancellation (FAC) signal 125 and 175 in the frames 105 and 110 and similarly in the frames 155 and 160 where the transition occurs. The FAC signal 125 may include an aliasing cancellation component 129 and a symmetric windowed signal 127. The FAC signal 125 may be forwarded to the decoder from the encoder, where the FAC signals 125 and 175 are added to the corresponding lossy time segments 120 and 165 at the frames 105 and 110 and 155 and 160 where the transition occurs. As seen in diagrams 100 and 150, the FAC signals 125 and 175 may be symmetric windowed signals to the lossy time segments 120 and 165. When the FAC signals 125 and 175 are added to by the decoder, unaliased signals 130 and 180 are generated at the frames 110 and 155, where the transitions respectively occur.

Assuming there is no quantization error (of the FAC signal), the last rows of diagrams 100 and 150 represent lossless signals in the same frame as the lossy time segment 140. Since the lossless signals (dummy signal 115 in frame $X_0$ 105 in figure 100, and dummy signal 170 in frame $X_3$ 160 in the figure 150) are available to the decoder for reconstruction, the FAC signals are not needed to cancel aliasing in the lossy time segments. Omitting transmission of the dummy signal by the encoder may reduce the need for side information transmission in encoder-side switching applications.

To avoid the shortcomings of conventional switching between lossy and lossless-encoded streams described above, a decoded signal of adjacent frames may be used to generate the relevant aliasing cancelation signals. Output audio signals may be reconstructed by adding a generated aliasing cancelation component to the decoded lossy time segment, and by normalizing the sum using a weight caused by the encoding window.

Figure 2:
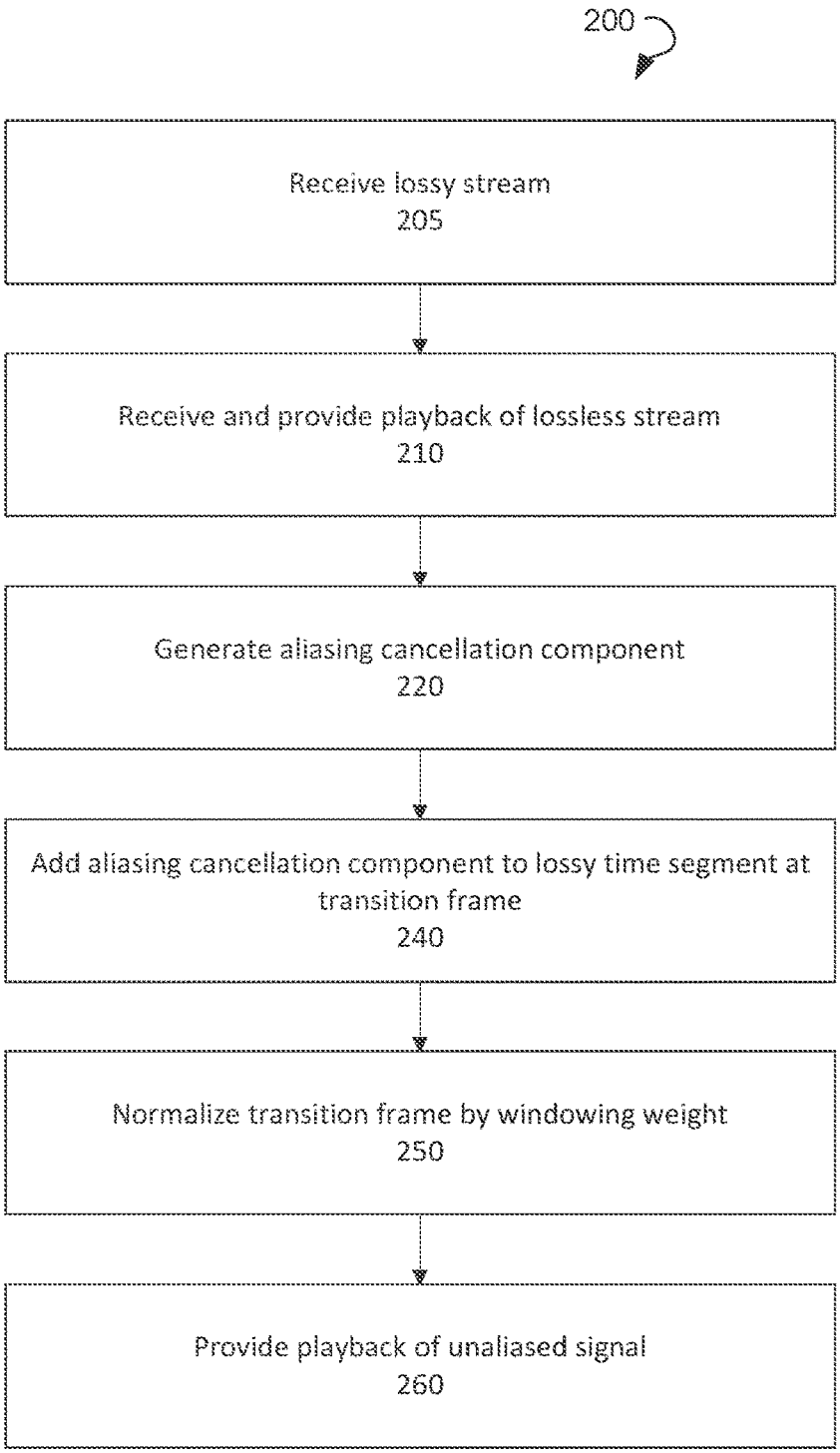
FIG. 2 shows a flow diagram for a method of switching between a lossy coded time segment and a lossless stream of the same source audio, according to an embodiment.

FIG. 2 shows a flow diagram for a method 200 of switching between a lossy coded time segment and a lossless stream of the same source audio, according to an embodiment. A decoder may receive lossy coded time segments that include audio encoded using a frequency-domain lossy coding method over a network at step 205. The decoder may also receive, over the network, a lossless stream that includes the audio encoded using a lossless coding method at step 210. In some embodiments, the lossless coding method may be a time domain coding method, as is commonly the case. The decoder may also provide audio playback of the lossless stream. In a specific application, the lossy and lossless streams may be transmitted in parallel over the network, so switching may be performed at any time desired by a user interacting with the decoder. To further facilitate switching, the lossy coded time segments and the lossless stream may be encoded from the same source audio and may also be time-aligned. Furthermore, the lossy and lossless sub-streams (when streamed together) may share a same video frame rate and may have a same sampling rate.

Figure 3:
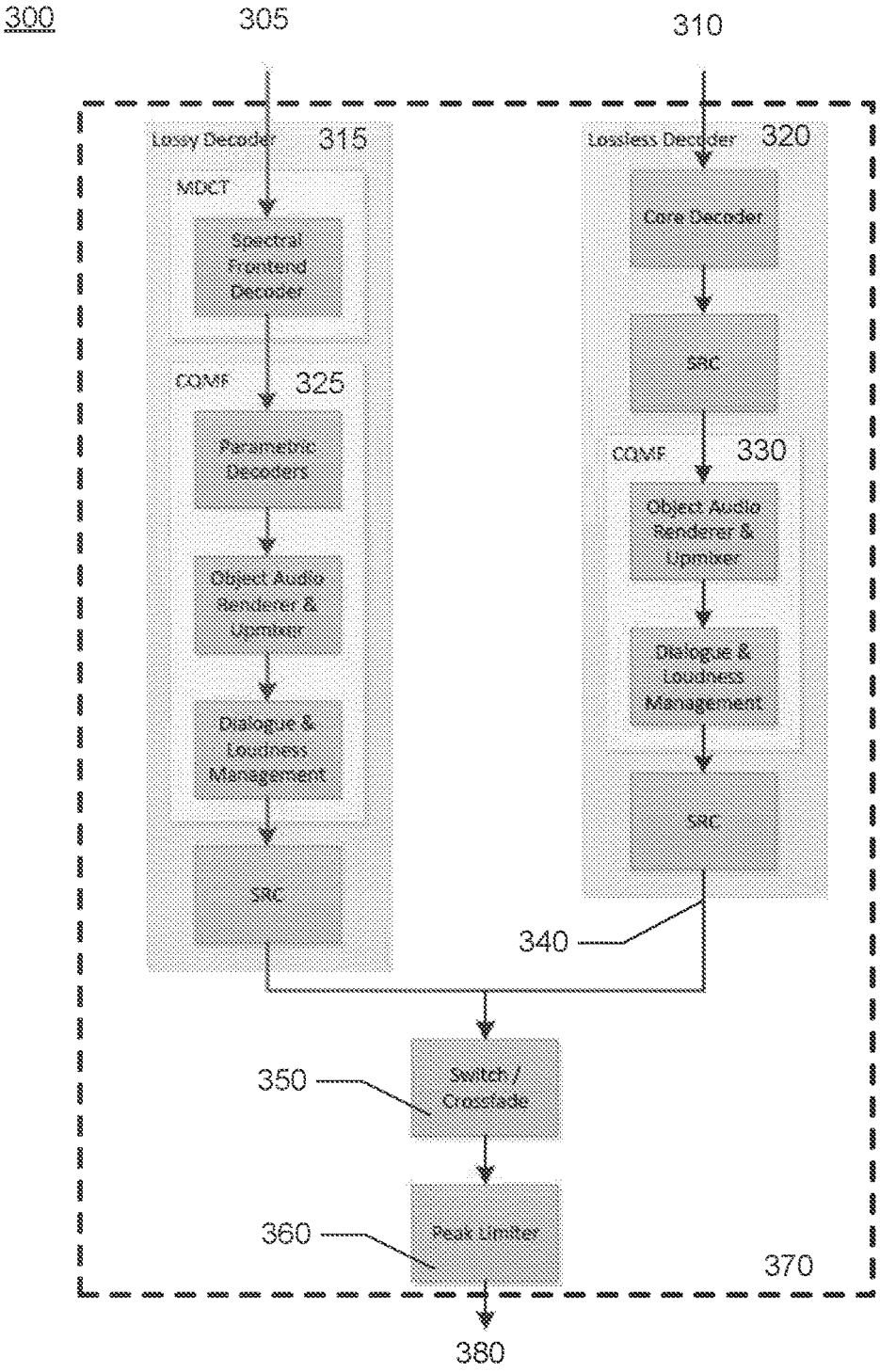
FIG. 3 shows a simplified block diagram of a system for switching between a lossy coded time segment and a lossless stream of the same source audio, according to an embodiment.

In response to receiving a determination that network bandwidth is constrained, the decoder may switch the playback from the lossless stream to the lossy coded time segments. FIG. 3 shows a simplified block diagram of a decoder 300 for switching between lossy coded time segments and a lossless stream of the same source audio, according to an embodiment. Decoder 300 may include lossy decoder 315, which receives and decodes lossy coded time segments 305, and lossless decoder 320, which receives and decodes lossless stream 310. FIG. 3 also shows typical peripheral components of AC-4 lossless and lossy decoder. While a high-level summary of the components shown in FIG. 3 is given below, further detail may be found in Riedmiller et al., Delivering Scalable Audio Experiences using AC-4, IEEE Transactions on Broadcasting, Vo. 63, no. 1, March 2017 pp. 179-198, incorporated by reference herein.

Lossy decoder 315 includes an MDCT spectral front end decoder, complex quadrature mirror filters (CQMF) 325, and an SRC. The MDCT spectral front end decoder may use an MDCT domain signal buffer to predict each bin of the lossy coded time segments. The CQMF 325 may include three modules as shown: modules for parametric decoders, object audio renderer and upmixer module, and dialogue and loudness management module. The parametric decoders may include a plurality of coding tools, including one or more of companding, advanced spectral extension algorithms, advanced coupling, advanced joint object coding, and advanced joint channel coding. The object audio renderer and upmixer module may perform spatial rendering of decoded audio based on metadata associated with the received lossy coded time segments. The dialogue and loudness management module may allow users to adjust the relative level of voice and adjust loudness filtering and/or processing. The SRC (sampling rate conversion) module may perform video frame synchronizing at a desired frame rate.

The exemplary lossless decoder 320 may include a core decoder, an SRC module (which operates substantially similarly to the SRC of the lossy decoder 315, though it may be likely that the SRC of the lossless decoder 320 operates in the time domain, rather than the frequency domain), a CQMF 330, and a second SRC module, applied after the CQMF 330 has been applied to the received lossless stream 310. The core decoder may be any suitable lossless decoder. The CQMF 330 may include an object audio renderer and upmixer module and a dialogue and loudness management module. The sub-modules of CQMF 330 may function substantially similarly to the corresponding modules of CQMF 325, again with the caveat that objects CQMF 330 operates on may be encoded in the time domain, while the objects that CQMF 325 operate on may be in the frequency domain.

There are several potential points in the decoding process where the lossy/lossless switching of method 200 may be inserted. A first potential switching point may be achieved by running MDCT on the pulse-code modulation (PCM) output 340 of the lossless decoder 320, and splicing the MDCT output of the lossless decoder with the MDCT output of the lossy decoder 315. Switching after running MDCT on the output 340 of the lossless decoder 320 may advantageously provide built-in MDCT overlap/add to facilitate smooth transitions. However, running an additional MDCT module on the output 340 of the lossless decoder 320 adds complexity to the decoder, and would also have to go through the sample rate converter (SRC, often required to deal with video frame synchronous audio coding feature in AC-4) if the video frame-rate is used. Switching after running MDCT on the output 340 of the lossless decoder 320 may also be problematic for object-based audio if programs have different numbers/arrangement of objects, and risks being non-seamless if the switching takes place before application of parametric decoding tools.

A second potential switching point may be at the PCM stage between MDCT and the CQMF 325 of the lossy decoder. However, switching before the CQMF 325 may necessitate a smooth fading strategy, and in addition may suffer from the same problems as switching after running MDCT on the output 340 of the lossless decoder 320 described above.

A third potential switching point may take place at the indicated switch/crossfade block 350, before the peak-limiter 360 (which may be any suitable post-processing module) is applied to the output of the decoder 380. While switching at block 350 may also require a smooth fading strategy, there are several key benefits to switching at 350. Notably, since all content is rendered to the same number of output speakers, programs with different numbers/arrangements of objects may be switched, thereby avoiding a major drawback of the first two switching points described above.

Figure 4B:
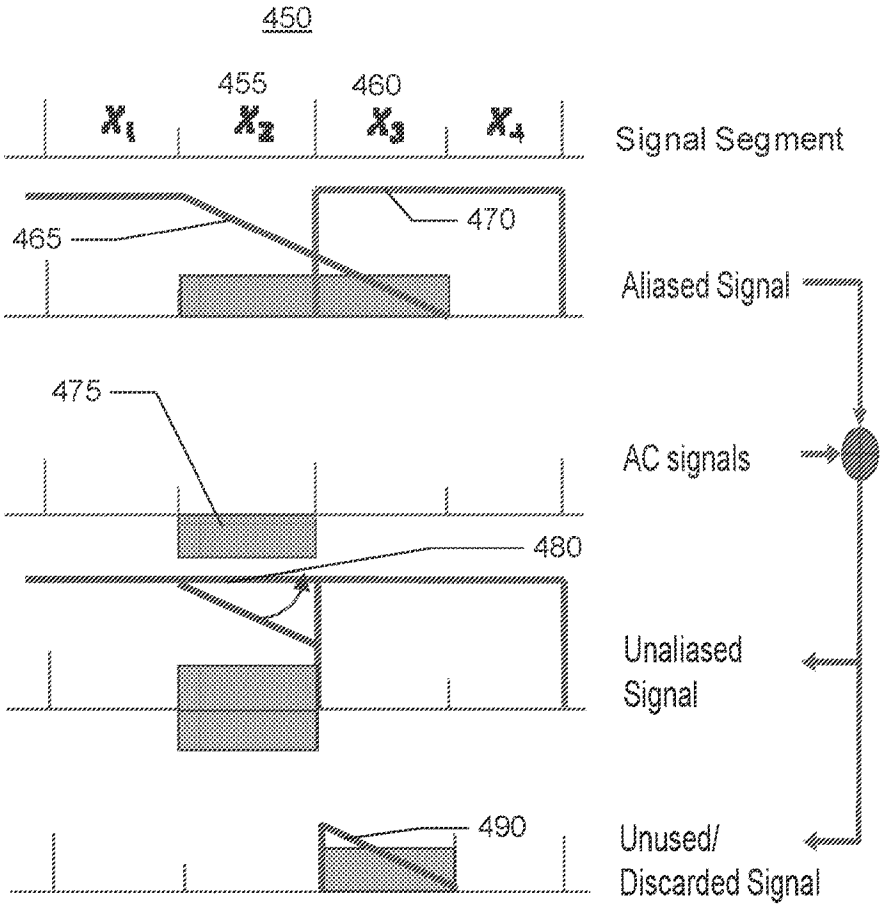
FIGS. 4A-B show exemplary signal segments where minimized forwarding aliasing cancelation is used to switch between a lossy coded time segment and a lossless stream, according to an embodiment.
Figure 4A:
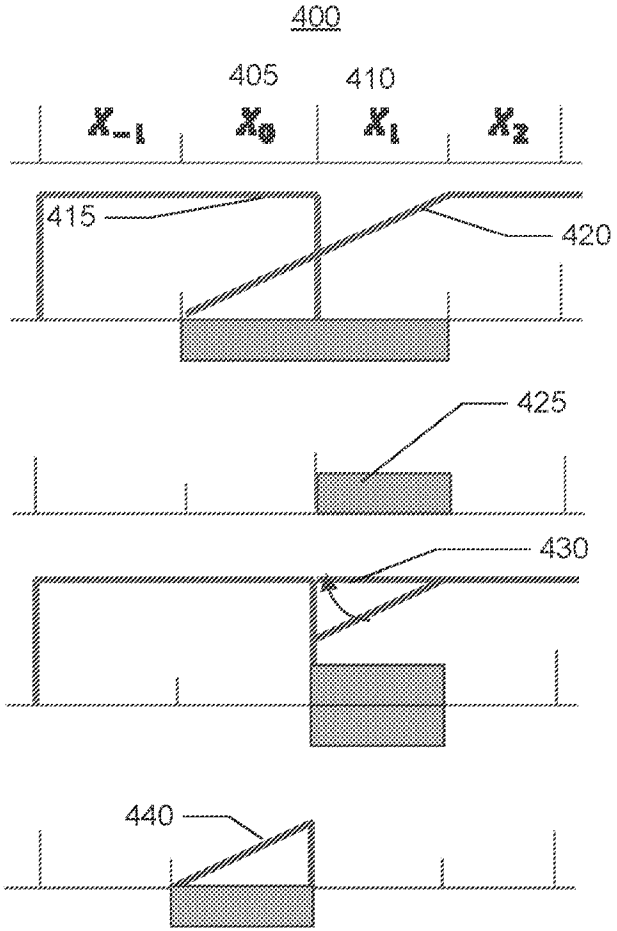

Returning to FIG. 2, in response to receiving a determination that network bandwidth is constrained, the decoder may generate an aliasing cancellation component based on previously-decoded frames of the lossless stream at step 220. In the discussion below, reference is also made to FIG. 4A, a diagram 400 which shows exemplary signal segments where minimized forwarding aliasing cancelation (AC) is used to switch between lossy coded time segments and a lossless stream, according to an embodiment.

AC signal 425 may be derived, without side information from the encoder, by expressing the lossless segment 415 before transition frame $X_1$ 410, during frame $X_0$ 405, in terms of being a sum of an aliased signal and an aliasing cancellation component. To do so, time domain lossy aliased samples may be derived in terms of the original lossless data samples. Based on research published in Britanak, Vladimir, and Huibert J. Lincklaen Arriëns. "Fast computational structures for an efficient implementation of the complete TDAC analysis/synthesis MDCT/MDST filter banks." Signal Processing 89.7 (2009): 1379-1394 (hereinafter referred to as "Britanak," and incorporated by reference herein), the aliased data samples for each lossy signal segment in diagram 100 may be expressed as:

$$\hat{x}_n^{MDCT} = x_n - J_{\frac{N}{4}} x_{n+\frac{N}{4}} = x_n - x_{\frac{N}{2}-1-n} \tag{1}$$

$$\hat{x}_{n+\frac{N}{4}}^{MDCT} = -J_{\frac{N}{4}} x_n + x_{n+\frac{N}{4}} \rightarrow \hat{x}_{\frac{N}{2}-1-n}^{MDCT} = -\hat{x}_n^{MDCT} \tag{2}$$

$$\hat{x}_{n+\frac{N}{2}}^{MDCT} = x_{n+\frac{N}{2}} + J_{\frac{N}{4}} x_{n+\frac{3N}{4}} = x_n + x_{N-1-n} \tag{3}$$

-continued $$\hat{x}_{n+\frac{3N}{4}}^{MDCT} = J_{\frac{N}{4}} x_{n+\frac{N}{2}} + x_{n+\frac{3N}{4}} \rightarrow \hat{x}_{N-1-n}^{MDCT} = \hat{x}_{n+\frac{N}{2}}^{MDCT} \tag{4}$$

That is, equations (1)-(4) refer to lossy time segment signals in each of frames $X_0$-$X_3$, for example. J in equations (1)-(4) may refer to an identity matrix that time reverses a signal vector. In an exemplary embodiment, J may be the matrix:

$$J_4 = \begin{bmatrix} 0 & 0 & 0 & 1 \\ 0 & 0 & 1 & 0 \\ 0 & 1 & 0 & 0 \\ 1 & 0 & 0 & 0 \end{bmatrix}.$$

Based on equation (2), the aliased lossy signal $\hat{x}_1$ for frame $X_1$ 410 may be rewritten as $$-JX_0+X_1$$

A MDCT window vector Wk may be introduced, causing the above equation to be rewritten as:

$$-JX_0 \circ W_0+X_1 \circ W_1. \tag{5}$$

In equation (5), the ° indicates element-wise multiplication between the window vectors $W_0$ and $W_1$ by the lossless signal segment vectors $X_0$ and $X_1$ respectively. As described in Britanak, the following constraints exist upon the windowing vector for perfect reconstruction of the lossy signal segment to occur:

$$W_0 J = W_3 \text{ and } W_1 J = W_2$$

$$W_k \cdot W_k + W_{k+2} \cdot W_{k+2} = [1 \ldots 1]$$

Based on the foregoing, the decoder may reconstruct a transition frame lossless signal during time segment $X_1$ 410 as a sum of a lossy time segment component 420 and an aliasing cancellation component based on adjacent (previous, in the case of switching from lossless to lossy) lossless time segment 415. The determined aliasing cancellation component from segment 415 may then be used to extrapolate the aliasing cancellation component for frame $X_1$ 410. The unused determined AC signal 440 can be discarded, because this particular time segment can be reconstructed by the lossless decoder. Returning to FIG. 2, the generated aliasing cancellation component 425 may be added to the lossy time segment 420 at a transition frame 410 at step 240. The sum of the aliasing cancellation component and the lossy time segment may be normalized using a weight caused by the encoding window applied to the transition frame at step 250, thereby providing aliasing cancellation at the transition frame.

An exemplary unaliased signal 430 for frame $X_1$ may be expressed as shown below, in equation (6).

$$[-(X_0 \circ W_0 - JX_1 \circ W_1)J + X_0 \circ W_0 J] \circ W_1^{-1}. \tag{6}$$

In equation (6) the aliasing cancellation component is the leftmost term, derived from equation (2) and the rightmost term is the lossy time segment component. From Equation (2), $-JX_0W_0$ is the aliasing component in the time-domain aliased signal in Equation (5) for frame $X_1$. To correct for this aliasing component, the leftmost term in Equation (6), generated based on the decoder previously decoding frame $X_0$ of the lossless stream 415, is added to the lossy time segment component for frame $X_1$. Equation (6) also illustrates the normalizing step 250, as the terms are multiplied by the inverse window function term $W_1^{-1}$ for transition frame $X_1$ 410. Audio playback of the lossy coded time segment may then be provided by the decoder at step 260, beginning with the unaliased signal 430 at the transition frame.

Figure 5:
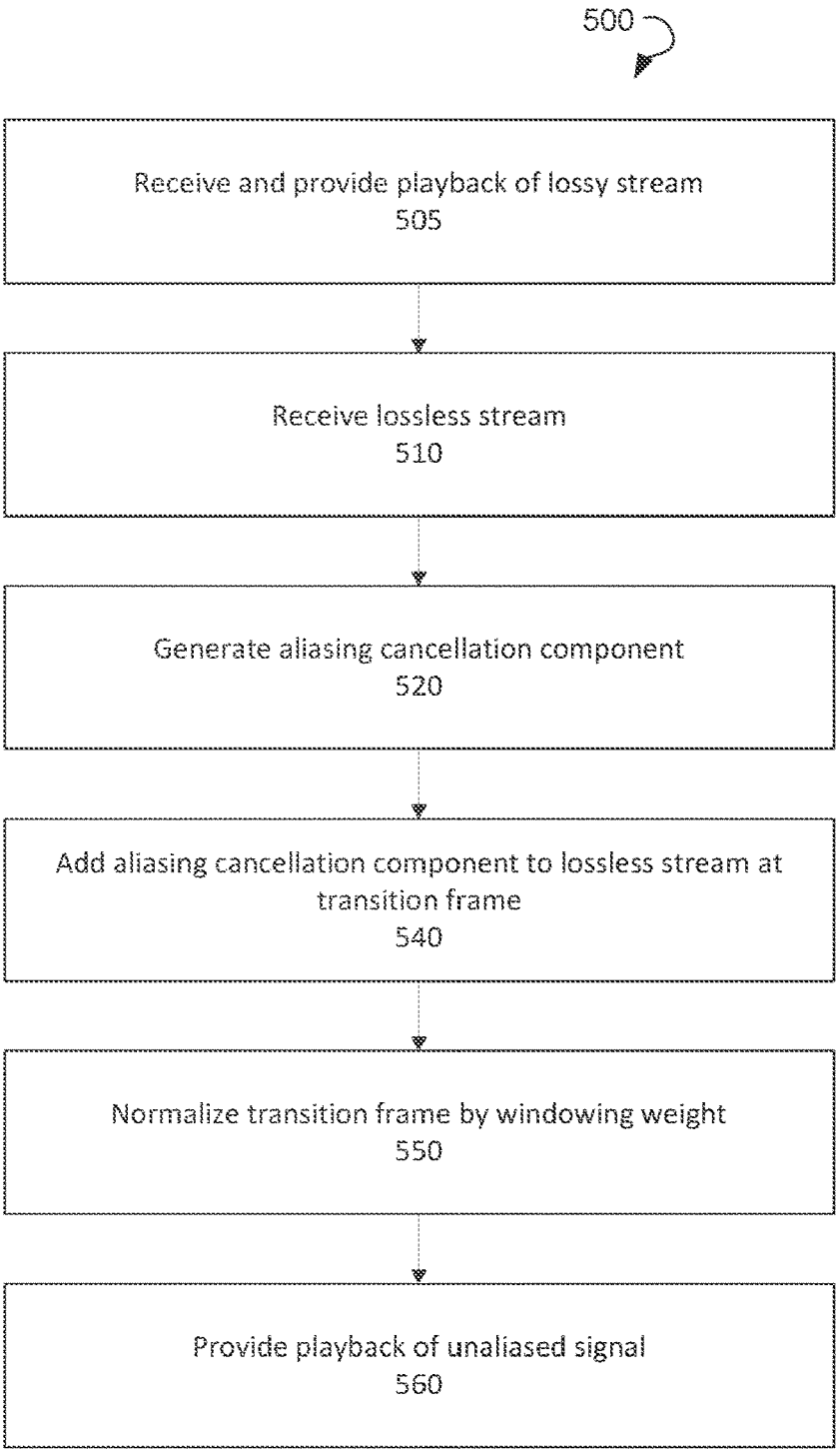
FIG. 5 shows a flow diagram for a method of switching back from a lossy coded time segment to a lossless stream of the same source audio, according to an embodiment.

While the above discussion focuses on the transition from lossless encoding to lossy encoding, the reverse operation may be performed as well using the principles of the present invention. FIG. 5 shows a flow diagram for a method 500 of switching back from lossy coded time segments to a lossless stream of the same source audio, according to an embodiment. In the discussion below, reference is also made to FIG. 4B, a diagram 450 which shows exemplary signal segments where minimized forwarding aliasing cancelation is used to switch between a lossy coded time segment and a lossless stream, according to an embodiment.

Similarly as described above in the discussion of FIG. 2, the decoder may receive a lossy time segment 465 that includes audio encoded using a lossy coding method over a network at step 505. The decoder may also provide audio playback of the lossy coded time segments. The decoder may also receive, over the network, a lossless stream 470 that includes the audio encoded using a lossless coding method at step 510. In response to receiving a determination that network bandwidth is no longer constrained, the decoder may switch the playback from the lossy coded time segments to the lossless stream. The decoder may perform the switch automatically, after determining that network bandwidth exceeds a predetermined threshold for providing adequate performance for the lossless stream, or in response to a user-provided indication on an interface in communication with the decoder.

To switch from a lossy coded time segment to the lossless stream, the decoder may generate an aliasing cancellation component 475 based on previously-decoded frames of the lossless stream at step 520. In the case of switching from lossy coding to lossless coding, the previously-decoded frame may be the subsequent frame (i.e., the first decoded frame of the lossless stream). To derive the aliasing cancellation component 475, the aliased lossy time segment for frame $X_2$ 455 may be rewritten, based on equation (3) as:

$$X_2+JX_3.$$

As described above, MDCT window vector $W_k$ may be introduced, causing the above equation to be rewritten as:

$$X_2 \circ W_2+JX_2 \circ W_2 \tag{7}$$

Based on the conditions on perfect reconstruction described above, the decoder may reconstruct transition frame $X_2$ 455 as a sum of a lossy time segment component 465 and aliasing cancellation component for adjacent time segment $X_3$ 460. Using lossless signals from frames after the transition frame is possible due to the decoder receiving both the lossy and the lossless streams, and by buffering decoded time segments of the lossless stream. The determined aliasing cancellation component for segment $X_3$ 460 may then be used to extrapolate the aliasing cancellation component for frame $X_2$ 455. Returning to FIG. 5, the generated aliasing cancellation component 475 may be added to the lossy time segment 465 at a transition frame 455 at step 540. The sum of the aliasing cancellation component and the lossy time segment may be normalized using a weight caused by the encoding window applied to the transition frame at step 550, thereby providing aliasing cancellation at the transition frame.

An exemplary unaliased signal 480 for frame $X_3$ may be expressed as shown below, in equation (8).

$$[(JX_2 \circ W_2+X_3 \circ W_3)J-X_3 \circ W_3 J] \circ W_2^{-1}. \tag{8}$$

In equation (8) the aliasing cancellation component is the rightmost term, derived from equation (3) and the leftmost term is the lossy time segment component. From Equation (3), $JX_3W_3$ is the aliasing component in the time-domain aliased signal in Equation (7) for frame $X_3$. To correct for this aliasing component, the rightmost term in equation (8), generated based on the decoder previously-decoding (yet subsequent) frame $X_3$ of the lossless stream 470, is added to the lossy time segment component for transition frame $X_2$. Equation (8) illustrates the normalizing step 550 as well, where the terms are multiplied by the inverse window function term $W_2^{-1}$ for transition frame $X_2$ 455. Audio playback of the lossless stream may then be provided by the decoder, after the unaliased signal 480 at step 560.

Figure 6:
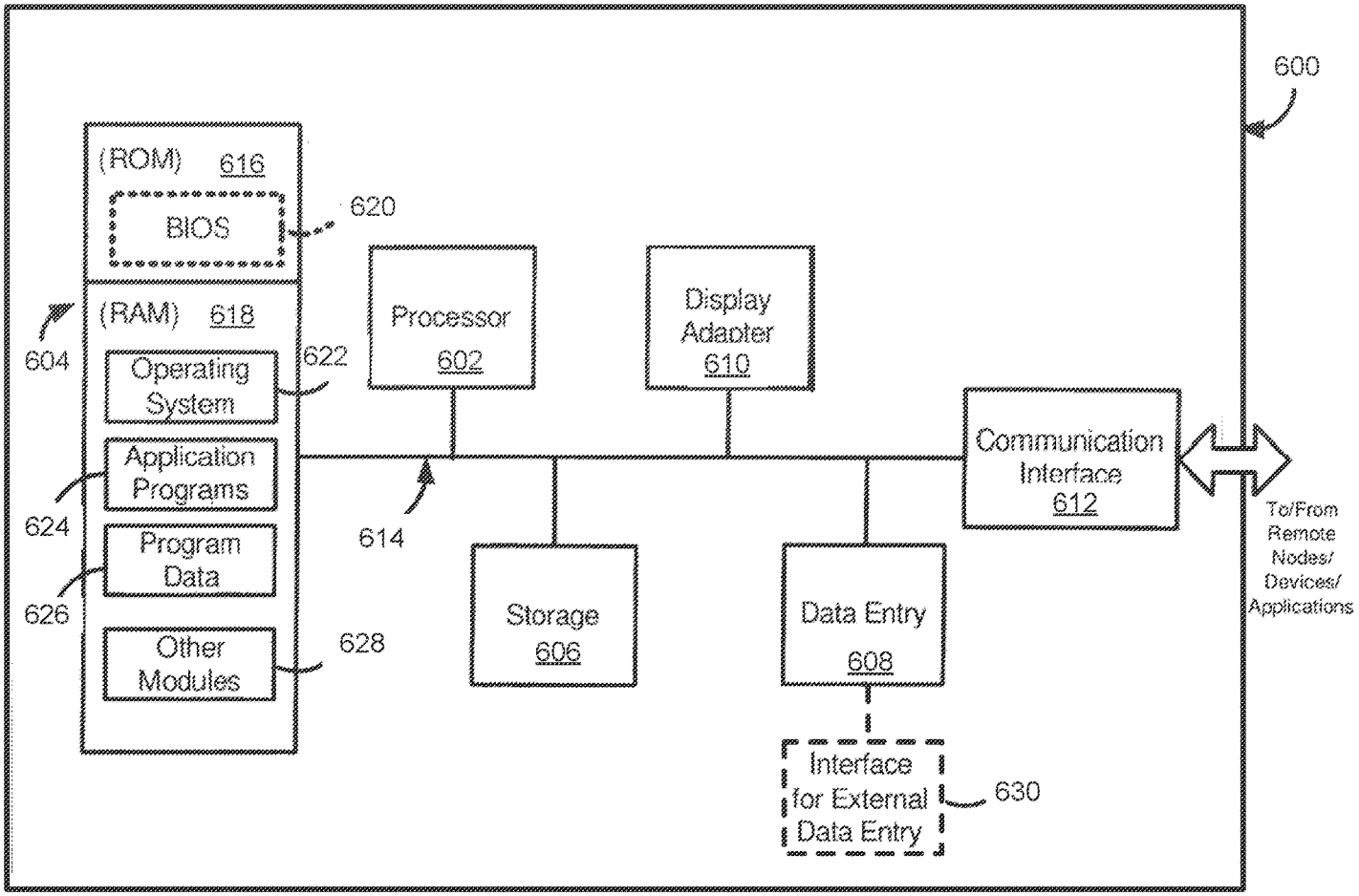
FIG. 6 is a block diagram of an exemplary system for switching between a lossy coded time segment and a lossless stream of the same source audio, according to an embodiment.

FIG. 6 is a block diagram of an exemplary system for providing decoder-side switching between lossy coded time segments and a lossless stream of the same source audio as described above. With reference to FIG. 6, an exemplary system for implementing the subject matter disclosed herein, including the methods described above, includes a hardware device 600, including a processing unit 602, memory 604, storage 606, data entry module 608, display adapter 610, communication interface 612, and a bus 614 that couples elements 604-612 to the processing unit 602.

The bus 614 may comprise any type of bus architecture. Examples include a memory bus, a peripheral bus, a local bus, etc. The processing unit 602 is an instruction execution machine, apparatus, or device and may comprise a microprocessor, a digital signal processor, a graphics processing unit, an application specific integrated circuit (ASIC), a field programmable gate array (FPGA), etc. The processing unit 602 may be configured to execute program instructions stored in memory 604 and/or storage 606 and/or received via data entry module 608.

The memory 604 may include read only memory (ROM) 616 and random access memory (RAM) 618. Memory 604 may be configured to store program instructions and data during operation of device 600. In various embodiments, memory 604 may include any of a variety of memory technologies such as static random access memory (SRAM) or dynamic RAM (DRAM), including variants such as dual data rate synchronous DRAM (DDR SDRAM), error correcting code synchronous DRAM (ECC SDRAM), or RAMBUS DRAM (RDRAM), for example. Memory 604 may also include nonvolatile memory technologies such as nonvolatile flash RAM (NVRAM) or ROM. In some embodiments, it is contemplated that memory 604 may include a combination of technologies such as the foregoing, as well as other technologies not specifically mentioned. When the subject matter is implemented in a computer system, a basic input/output system (BIOS) 620, containing the basic routines that help to transfer information between elements within the computer system, such as during start-up, is stored in ROM 616.

The storage 606 may include a flash memory data storage device for reading from and writing to flash memory, a hard disk drive for reading from and writing to a hard disk, a magnetic disk drive for reading from or writing to a removable magnetic disk, and/or an optical disk drive for reading from or writing to a removable optical disk such as a CD ROM, DVD or other optical media. The drives and their associated computer-readable media provide nonvolatile storage of computer readable instructions, data structures, program modules and other data for the hardware device 600.

It is noted that the methods described herein can be embodied in executable instructions stored in a non-transitory computer readable medium for use by or in connection with an instruction execution machine, apparatus, or device, such as a computer-based or processor-containing machine, apparatus, or device. It will be appreciated by those skilled in the art that for some embodiments, other types of computer readable media may be used which can store data that is accessible by a computer, such as magnetic cassettes, flash memory cards, digital video disks, Bernoulli cartridges, RAM, ROM, and the like may also be used in the exemplary operating environment. As used here, a "computer-readable medium" can include one or more of any suitable media for storing the executable instructions of a computer program in one or more of an electronic, magnetic, optical, and electromagnetic format, such that the instruction execution machine, system, apparatus, or device can read (or fetch) the instructions from the computer readable medium and execute the instructions for carrying out the described methods. A non-exhaustive list of conventional exemplary computer readable medium includes: a portable computer diskette; a RAM; a ROM; an erasable programmable read only memory (EPROM or flash memory); optical storage devices, including a portable compact disc (CD), a portable digital video disc (DVD), a high definition DVD (HD-DVD™), a BLU-RAY disc; and the like.

A number of program modules may be stored on the storage 606, ROM 616 or RAM 618, including an operating system 622, one or more applications programs 624, program data 626, and other program modules 628. A user may enter commands and information into the hardware device 600 through data entry module 608. Data entry module 608 may include mechanisms such as a keyboard, a touch screen, a pointing device, etc. Other external input devices (not shown) are connected to the hardware device 600 via external data entry interface 630. By way of example and not limitation, external input devices may include a microphone, joystick, game pad, satellite dish, scanner, or the like. In some embodiments, external input devices may include video or audio input devices such as a video camera, a still camera, etc. Data entry module 608 may be configured to receive input from one or more users of device 600 and to deliver such input to processing unit 602 and/or memory 604 via bus 614.

The hardware device 600 may operate in a networked environment using logical connections to one or more remote nodes (not shown) via communication interface 612. The remote node may be another computer, a server, a router, a peer device or other common network node, and typically includes many or all of the elements described above relative to the hardware device 600. The communication interface 612 may interface with a wireless network and/or a wired network. Examples of wireless networks include, for example, a BLUETOOTH network, a wireless personal area network, a wireless 802.11 local area network (LAN), and/or wireless telephony network (e.g., a cellular, PCS, or GSM network). Examples of wired networks include, for example, a LAN, a fiber optic network, a wired personal area network, a telephony network, and/or a wide area network (WAN). Such networking environments are commonplace in intranets, the Internet, offices, enterprise-wide computer networks and the like. In some embodiments, communication interface 612 may include logic configured to support direct memory access (DMA) transfers between memory 604 and other devices.

In a networked environment, program modules depicted relative to the hardware device 600, or portions thereof, may be stored in a remote storage device, such as, for example, on a server. It will be appreciated that other hardware and/or software to establish a communications link between the hardware device 600 and other devices may be used.

It should be understood that the arrangement of hardware device 600 illustrated in FIG. 6 is but one possible implementation and that other arrangements are possible. It should also be understood that the various system components (and means) defined by the claims, described above, and illustrated in the various block diagrams represent logical components that are configured to perform the functionality described herein. For example, one or more of these system components (and means) can be realized, in whole or in part, by at least some of the components illustrated in the arrangement of hardware device 600. In addition, while at least one of these components are implemented at least partially as an electronic hardware component, and therefore constitutes a machine, the other components may be implemented in software, hardware, or a combination of software and hardware. More particularly, at least one component defined by the claims is implemented at least partially as an electronic hardware component, such as an instruction execution machine (e.g., a processor-based or processor-containing machine) and/or as specialized circuits or circuitry (e.g., discrete logic gates interconnected to perform a specialized function), such as those illustrated in FIG. 6. Other components may be implemented in software, hardware, or a combination of software and hardware. Moreover, some or all of these other components may be combined, some may be omitted altogether, and additional components can be added while still achieving the functionality described herein. Thus, the subject matter described herein can be embodied in many different variations, and all such variations are contemplated to be within the scope of what is claimed.

In the description above, the subject matter may be described with reference to acts and symbolic representations of operations that are performed by one or more devices, unless indicated otherwise. As such, it will be understood that such acts and operations, which are at times referred to as being computer-executed, include the manipulation by the processing unit of data in a structured form. This manipulation transforms the data or maintains it at locations in the memory system of the computer, which reconfigures or otherwise alters the operation of the device in a manner well understood by those skilled in the art. The data structures where data is maintained are physical locations of the memory that have particular properties defined by the format of the data. However, while the subject matter is being described in the foregoing context, it is not meant to be limiting as those of skill in the art will appreciate that various of the acts and operation described hereinafter may also be implemented in hardware.

For purposes of the present description, the terms "component," "module," and "process," may be used interchangeably to refer to a processing unit that performs a particular function and that may be implemented through computer program code (software), digital or analog circuitry, computer firmware, or any combination thereof.

It should be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

In the description above and throughout, numerous specific details are set forth in order to provide a thorough understanding of the disclosure. It will be evident, however, to one of ordinary skill in the art, that the disclosure may be practiced without these specific details. In other instances, well-known structures and devices are shown in block diagram form to facilitate explanation. The description of the preferred an embodiment is not intended to limit the scope of the claims appended hereto. Further, in the methods disclosed herein, various steps are disclosed illustrating some of the functions of the disclosure. One will appreciate that these steps are merely exemplary and are not meant to be limiting in any way. Other steps and functions may be contemplated without departing from this disclosure.

What is claimed is:

1. A method comprising:

receiving, by a decoder over a network, lossy coded time segments comprising audio encoded using a frequency-domain lossy coding method;

receiving, by the decoder over the network, a lossless stream, the lossless stream comprising the audio encoded using a lossless coding method, the lossy coded time segments and the lossless stream being encoded from the same source audio, being time-aligned, and having a same sampling rate, the decoder providing audio playback of the lossless stream;

in response to receiving a determination that network bandwidth is constrained:

generating, by the decoder, an aliasing cancellation component based on previously-decoded frames of the lossless stream;

adding the generated aliasing cancellation component to a lossy time segment at a transition frame;

normalizing, the sum of the generated aliasing cancellation component and the lossy time segment using a weight caused by an encoding window applied to the transition frame, thereby providing aliasing cancellation on the transition frame; and providing audio playback of the lossy coded time segments beginning with the aliasing-canceled transition frame.

2. The method of claim 1, wherein the lossy coding method uses MDCT with overlapping windows.

3. The method of claim 1, wherein the lossless coding method uses rectangular non-overlapping windows that are different from windows used by the lossy coding method.

4. The method of claim 1, further comprising, in response to receiving the determination that network bandwidth is constrained, selecting the transition frame to be before a peak-limiter is applied to the lossless stream.

5. The method of claim 1, the generating the aliasing cancellation component comprising:

reconstructing an adjacent frame of the previously-decoded frames of the lossless stream as a sum of a lossy component and an aliasing cancellation component for the adjacent frame; and extrapolating the aliasing cancellation component for the adjacent frame to generate the aliasing cancellation component.

6. The method of claim 1, the normalizing comprising multiplying by an inverse window function vector determined for the transition frame.

7. The method of claim 1, the determination that network bandwidth is constrained being received from a user-provided indication on an interface in communication with the decoder.

8. A computer program product comprising computer-readable program code to be executed by one or more processors when retrieved from a non-transitory computer-readable medium, the program code including instructions to:

receive lossy coded time segments comprising audio encoded using a frequency-domain lossy coding method;

receive a lossless stream, the lossless stream comprising the audio encoded using a lossless coding method, the lossy coded time segments and the lossless stream being encoded from the same source audio, being time-aligned, and having a same sampling rate, the decoder providing audio playback of the lossless stream;

in response to receiving a determination that network bandwidth is constrained:

generate, by the decoder, an aliasing cancellation component based on previously-decoded frames of the lossless stream;

add the generated aliasing cancellation component to a lossy time segment at a transition frame;

normalize the sum of the generated aliasing cancellation component and the lossy time segment using a weight caused by an encoding window applied to the transition frame, thereby providing aliasing cancellation on the transition frame; and provide audio playback of the lossy coded time segments beginning with the aliasing-canceled transition frame.

9. The computer program product of claim 8, wherein the lossy coding method uses MDCT with overlapping windows.

10. The computer program product of claim 8, wherein the lossless coding method uses rectangular non-overlapping windows that are different from windows used by the lossy coding method.

11. The computer program product of claim 8, the program code further including instructions to, in response to receiving the determination that network bandwidth is constrained, select the transition frame to be before a peak-limiter is applied to the lossless stream.

12. The computer program product of claim 8, wherein the instructions to generate the aliasing cancellation component include instructions to:

reconstruct an adjacent frame of the previously-decoded frames of the lossless stream as a sum of a lossy component and an aliasing cancellation component for the adjacent frame; and extrapolate the aliasing cancellation component for the adjacent frame to generate the aliasing cancellation component.

13. The computer program product of claim 8, wherein the instructions to normalize the aliasing-canceled transition frame include instructions to multiply the aliasing-canceled transition frame by an inverse window function vector determined for the transition frame.

14. The computer program product of claim 8, the determination that network bandwidth is constrained being received from a user-provided indication on an interface in communication with the decoder.

15. A decoder for audio streams comprising, a lossy decoder circuit that receives lossy coded time segments from a network connection, the lossy coded time segments comprising audio encoded using a frequency-domain lossy coding method;

a lossless decoder circuit that receives a lossless stream from the network connection, the lossless stream comprising the audio encoded using a lossless coding method, the lossy coded time segments and the lossless stream being encoded from the same source audio, being time-aligned, and having a same sampling rate, the decoder providing audio playback of the lossless stream; and an analysis circuit coupled to both the lossy decoder circuit and the lossless decoder circuit, the analysis circuit generating, in response to a determination that network bandwidth is constrained, an aliasing cancellation component based on previously-decoded frames of the lossless stream, adding the generated aliasing cancellation component to a lossy time segment at a transition frame, normalizing the sum of the generated aliasing cancellation component and the lossy time segment using a weight caused by an encoding window applied to the transition frame to provide aliasing cancellation on the transition frame, and providing audio playback of the lossy coded time segments beginning with the aliasing-canceled transition frame.

16. The system of claim 15, wherein the lossy coding method uses MDCT with overlapping windows.

17. The system of claim 15, wherein the lossless coding method uses rectangular non-overlapping windows that are different from windows used by the lossy coding method.

18. The system of claim 15, the analysis circuit selecting the transition frame to be before a peak-limiter is applied to the lossless stream.

19. The system of claim 15, the generating the aliasing cancellation component comprising:

reconstructing an adjacent frame of the previously-decoded frames of the lossless stream as a sum of a lossy component and an aliasing cancellation component for the adjacent frame; and extrapolating the aliasing cancellation component for the adjacent frame to generate the aliasing cancellation component.

20. The system of claim 15, the normalizing comprising multiplying by an inverse window function vector determined for the transition frame.

* * * * *